US007530544B2

(12) United States Patent
Takagi

(10) Patent No.: US 7,530,544 B2
(45) Date of Patent: May 12, 2009

(54) PANEL FORMING SYSTEM INCLUDING CONSTRUCTION COMPONENT HAVING HINGED PORTION ENGAGED WITH SET PORTION FORMING PANEL FORMING SURFACES AGAINST WHICH CURABLE MATERIALS ARE SHAPED

(75) Inventor: Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 357 days.

(21) Appl. No.: 11/056,943

(22) Filed: Feb. 11, 2005

(65) Prior Publication Data

US 2005/0205753 A1 Sep. 22, 2005

Related U.S. Application Data

(60) Provisional application No. 60/544,096, filed on Feb. 12, 2004, provisional application No. 60/544,184, filed on Feb. 12, 2004.

(51) Int. Cl.
*B28B 7/28* (2006.01)
*B28B 7/00* (2006.01)

(52) U.S. Cl. ..... 249/185; 249/177; 249/205

(58) Field of Classification Search ..... 249/183–186, 249/175, 177, 205, 207, 210; 52/720.1, 717.01, 52/717.05

See application file for complete search history.

(56) References Cited

U.S. PATENT DOCUMENTS 1,641,147 A * 9/1927 Barton ..... 249/186
2,386,582 A * 10/1945 Woodward ..... 249/177
2,940,152 A * 6/1960 Riehl ..... 249/188
3,085,367 A * 4/1963 De Ridder et al. ..... 52/538
3,111,203 A * 11/1963 De Ridder ..... 52/458
3,148,433 A * 9/1964 Carriker ..... 249/176
3,601,946 A * 8/1971 Rothemund ..... 52/844
3,632,078 A * 1/1972 Dashew ..... 249/183
3,754,729 A * 8/1973 Maynen ..... 249/40
3,782,680 A * 1/1974 Hopkins ..... 249/188
4,042,205 A * 8/1977 Herrell ..... 249/189
4,099,358 A * 7/1978 Compaan ..... 52/588.1
4,101,111 A * 7/1978 Bishop ..... 249/205
4,180,233 A * 12/1979 Johnson ..... 249/144
4,437,642 A * 3/1984 Holt ..... 249/175
4,659,057 A * 4/1987 Felter ..... 249/97
4,942,271 A * 7/1990 Corsi et al. ..... 174/101
5,598,681 A * 2/1997 DiGianni ..... 52/17.05
5,694,726 A * 12/1997 Wu ..... 52/287.1
5,836,134 A * 11/1998 Couto et al. ..... 52/718.02
5,922,235 A * 7/1999 Scott et al. ..... 249/16
5,956,912 A * 9/1999 Carter et al. ..... 52/396.02

(Continued)

*Primary Examiner*—Gay Ann Spahn
(74) *Attorney, Agent, or Firm*—Dinsmore & Shohl LLP

(57) ABSTRACT

A construction component is provided comprising a set portion, a hinged portion, and a hinge. The construction component defines an extruded cross-sectional profile defining a panel forming face configured such that an un-cured material may be cured against and subsequently released from the panel forming face in a substantially unobstructed manner. The hinge couples the set portion and the hinged portion such that the hinged portion is movable about the hinge between an engaged state and a disengaged state. The set portion and the hinged portion cooperate to define at least a portion of the panel forming face. The component can be configured such that movement of the hinged portion from the engaged state to the disengaged state reveals a component securing surface of the construction component.

17 Claims, 6 Drawing Sheets

U.S. PATENT DOCUMENTS 6,050,037 A * 4/2000 Gifford ..... 52/211
D424,215 S * 5/2000 Eyring et al. ..... D25/122
D428,162 S * 7/2000 Eyring et al. ..... D25/121
6,279,868 B1 * 8/2001 Eyring et al. ..... 249/177
6,322,045 B1 * 11/2001 Andros ..... 249/188
6,333,461 B1 * 12/2001 Marcou et al. ..... 174/68.3
6,398,180 B1 6/2002 Eyring et al.
6,437,244 B1 * 8/2002 Vander Velde ..... 174/68.3
6,467,226 B2 10/2002 Dodson et al.
6,540,201 B1 * 4/2003 Gagnon et al. ..... 249/139
6,609,341 B2 * 8/2003 Maylon et al. ..... 52/367
6,685,021 B2 2/2004 Dodson et al.
6,702,247 B2 3/2004 Takagi
6,736,366 B2 5/2004 Eyring et al.
6,749,171 B2 6/2004 Takagi
6,821,466 B2 11/2004 Takagi et al.
6,834,471 B2 * 12/2004 Takagi et al. ..... 52/699
6,840,018 B2 1/2005 Takagi
6,883,772 B2 4/2005 Takagi et al.
6,903,265 B1 * 6/2005 VanderVelde et al. ..... 174/481
7,004,443 B2 * 2/2006 Bennett ..... 249/185
2002/0059758 A1 * 5/2002 Dodson et al. ..... 52/204.1
2002/0062603 A1 * 5/2002 Shaw et al. ..... 52/125.1
2003/0025064 A1 2/2003 Takagi
2003/0025235 A1 2/2003 Takagi
2003/0084632 A1 5/2003 Takagi et al.
2003/0115816 A1 6/2003 Dodson et al.
2003/0141624 A1 7/2003 Takagi et al.
2004/0041074 A1 * 3/2004 Takagi ..... 249/205

* cited by examiner

PANEL FORMING SYSTEM INCLUDING CONSTRUCTION COMPONENT HAVING HINGED PORTION ENGAGED WITH SET PORTION FORMING PANEL FORMING SURFACES AGAINST WHICH CURABLE MATERIALS ARE SHAPED

CROSS-REFERENCE TO RELATED APPLICATIONS

This application claims the benefit of U.S. Provisional Application Ser. Nos. 60/544,096, filed Feb. 12, 2004, and 60/544,184, filed Feb. 12, 2004.

BACKGROUND OF THE INVENTION

The present invention relates to tilt-up, precast, cast-in-place, and other similar construction techniques where un-cured material, e.g., concrete, is introduced into a form and cured to assume the shape of the form. More particularly, the present invention relates to the configuration of the form and other construction components utilized with the form to supplement to the basic shape defined by the form. Examples of such components include form bulkheads, rustications or reveals, single chamfers, double chamfers, rounded chamfers, angled chamfers, rounded corner pieces, single and multi-component recess chamfers used at the edges of window and door openings, drip edge chamfers, and any other construction component configured to alter the cured shape of the material introduced into the form. The specific manner in which particular forms are constructed, the steps involved in introducing un-cured material into the form, and the steps associated with utilizing cured objects are beyond the scope of the present invention and can be readily gleaned from the art, including the published patent documents incorporated by reference herein.

Construction components according to the present invention may abut or be otherwise arranged upon an interior surface of a form to alter the interior boundaries of the form. Where the particular form at issue is configured upon a panel forming surface, such as a concrete panel forming slab, construction components according to the present invention may abut a surface of the panel forming slab bounded by the form, an interior surface of the form, or both the slab and the form.

BRIEF SUMMARY OF THE INVENTION

In accordance with one embodiment of the present invention, a construction component is provided comprising a set portion, a hinged portion, and a hinge. The construction component defines an extruded cross-sectional profile defining a panel forming face configured such that an un-cured material may be cured against and subsequently released from the panel forming face in a substantially unobstructed manner. The hinge couples the set portion and the hinged portion such that the hinged portion is movable about the hinge between an engaged state and a disengaged state. The set portion and the hinged portion cooperate to define at least a portion of the panel forming face. The component can be configured such that movement of the hinged portion from the engaged state to the disengaged state reveals a component securing surface of the construction component.

In accordance with another embodiment of the present invention, the construction component is provided with pliant sealing edges extending along the longitudinal dimension of the construction component.

In accordance with another embodiment of the present invention, the construction component is provided as part of a panel forming system such that an un-cured material can be contained within respective panel forming sections of the panel forming system in the shape of a panel.

Accordingly, it is an object of the present invention to provide for improvements in tilt-up, precast, cast-in-place, and other similar construction techniques where un-cured material, e.g., concrete, is introduced into a form and cured to assume the shape of the form. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
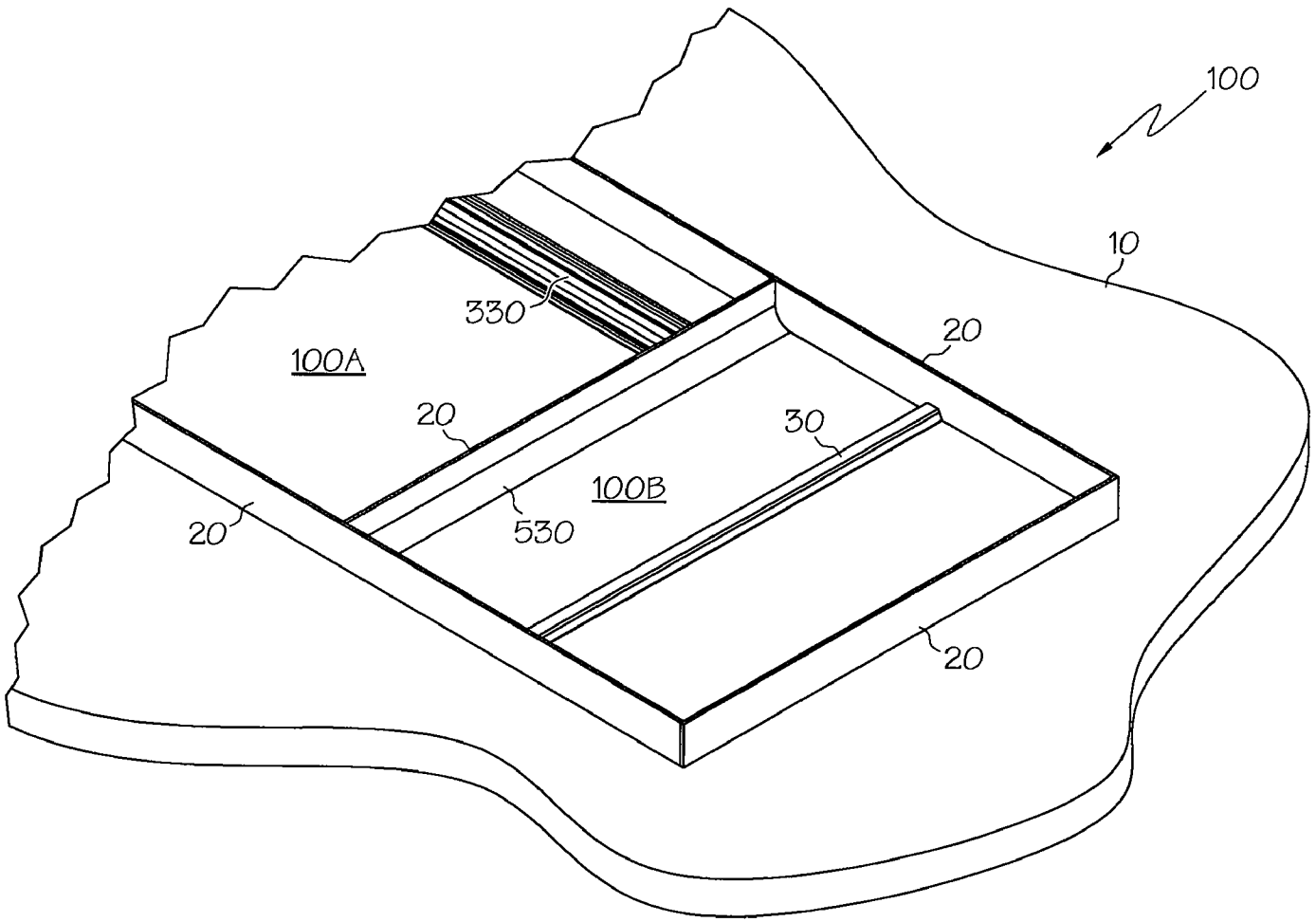
FIG. 1 is an illustration of a panel forming system including construction components according to the present invention.
Figure 2A:
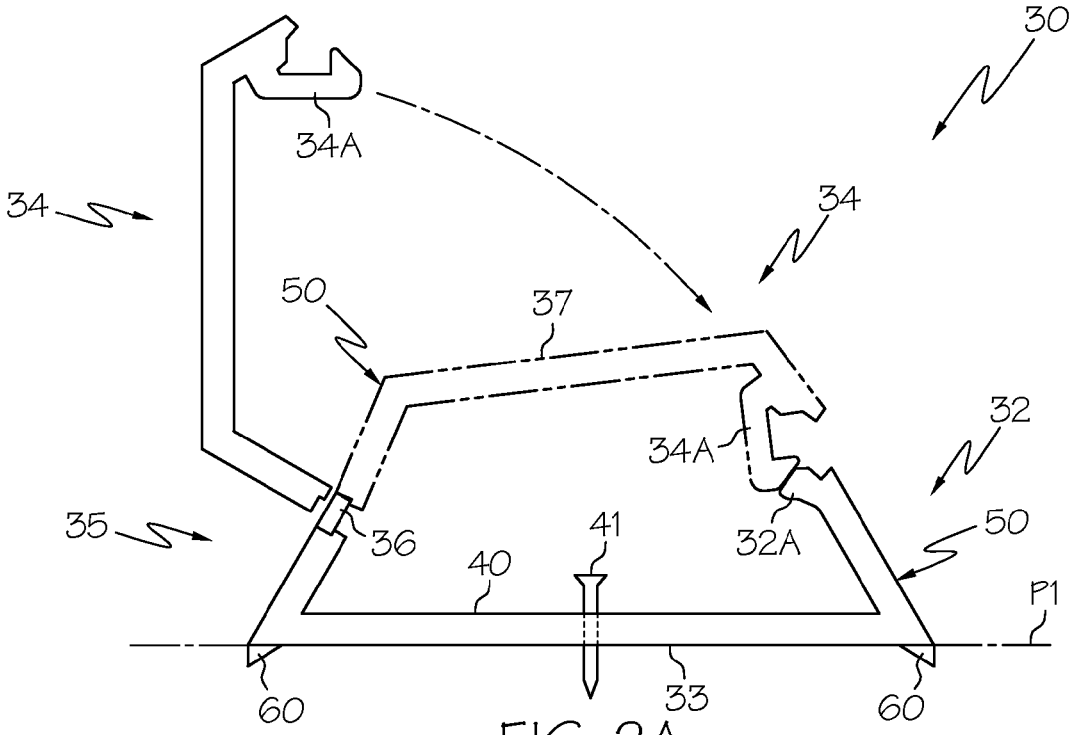
FIGS. 2A and 2B are cross-sectional illustrations of a construction component according to the present invention configured as a rustication configured to define a decorative strip in panels cured within a panel forming section of a panel form.
Figure 2B:
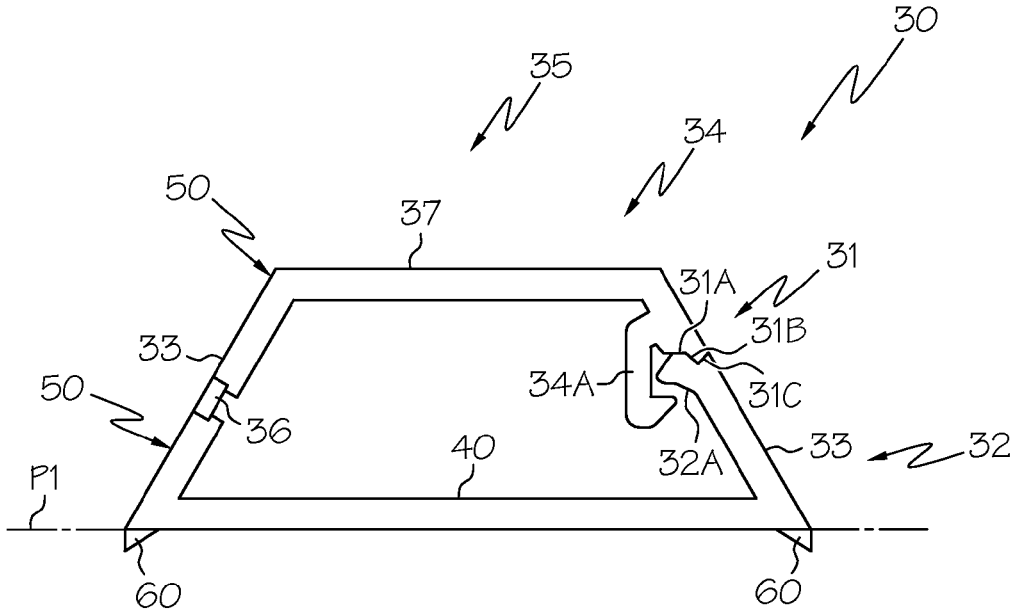

Construction components according to the present invention can be utilized in a variety of contexts. Referring specifically to FIG. 1, a panel forming system 100 is illustrated and comprises a panel forming slab 10 and a plurality of panel forming bulkheads 20 arranged such that an un-cured material, e.g., concrete, can be introduced and contained within individual panel forming sections 100A, B, etc., of the system 100 in the shape of respective panels. Individual construction components 30, 330, 530 are included in each panel forming section 100A, B as a supplement to the remaining components of the panel forming system 100 and are configured to further define the shape of respective panels cured within the sections 100A, B.

Each of the various construction components 30, 130, 230, 330,430, 530 according to the present invention comprises some type of supplemental panel form and can be configured to serve a variety of functions. For example, and not by way of limitation, construction components 30, 130, 230, 330, 430, 530 according to the present invention may comprise corner chamfer positioned at the intersection of a bulkhead 20 and the panel forming slab 10, a double chamfer positioned to receive and support a bulkhead 20 defining the partition between adjacent panel forming sections 100A, 100B of the panel forming system 100, a rustication positioned to define a decorative strip in panels cured within the panel forming sections 100A, 100B, a drip edge form positioned to define drainage features in a cured panel, or any other conventional or yet to be developed supplemental panel form where the features of the present invention may find utility.

Referring collectively to the construction components 30, 130, 230, 330, 430, 530 illustrated in the accompanying drawings, components according to the present invention comprise a set portion 32, 132, 232, 332, 432, 532, a hinged portion 34, 134, 234, 334, 434, 534, and a hinge 36, 136, 236, 336, 436, 536, and generally define an extruded cross-sectional profile. The set portion 32, 132, 232, 332, 432, 532 and the hinged portion 34, 134, 234, 334, 434, 534 of the extruded cross-sectional profile cooperate to define at least a portion of a panel forming face 35, 135, 235, 335, 435, 535 configured such that an un-cured material may be cured against and subsequently released from the panel forming face 35, 135, 235, 335, 435, 535 in a substantially unobstructed manner. In this manner, the construction components 30 are left in the respective panel forming sections 100A, B when a cured panel is removed there from. It is contemplated that panel forming faces according to the present invention may take a variety of forms including, but not limited to, those illustrated in the accompanying drawings.

For the purposes of defining and describing the present invention it is noted that a component that defines an extruded cross sectional profile defines a substantially uniform cross section that extends along substantially the entire length of the component. It is contemplated that bodies defining an extruded cross sectional profile may, to a limited extent, embody variations in the uniformity of the cross section due to fabrication process errors or post fabrication process steps. For example, holes may be drilled in an extruded member in specific locations after the member is extruded. Similarly, cuts or cutouts may be formed in the extruded member or the extruded member may be bent or deformed after it is extruded.

The set portion 32, 132, 232, 332, 432, 532, hinged portion 34, 134, 234, 334, 434, 534, and hinge 36, 136, 236, 336, 436, 536 define integral portions of the extruded cross-sectional profile of construction components 30, 130, 230, 330, 430, 530 according to the present invention. To facilitate reliable and repeatable movement of the hinged portion 34, 134, 234, 334, 434, 534 about the hinge 36, 136, 236, 336, 436, 536, the hinge 36, 136, 236, 336, 436, 536 is formed of a material that is substantially less rigid than that of the set portion 32, 132, 232, 332, 432, 532 and the hinged portion 34, 134, 234, 334, 434, 534.

The panel forming faces 35, 135, 235, 335, 435, 535 contemplated by the present invention will typically comprise at least one profiled portion 50, 150, 250, 350, 450, 550 defined therein that provided access to a component securing surface 40, 140, 240, 340, 440, 540. The particular shape of the profiled portion 50, 150,250,350,450,550 may comprise a beveled portion, a vertical or horizontal linear portion, an inwardly curved portion, an outwardly curved portion, or combinations thereof. Profiled portions 50, 150, 250, 350, 450, 550 according to the present invention may be formed from set portions 32, 132,232, 332, 432, 532 and hinged portions 34, 134, 234, 334, 434, 534, individually or collectively.

Figure 4A:
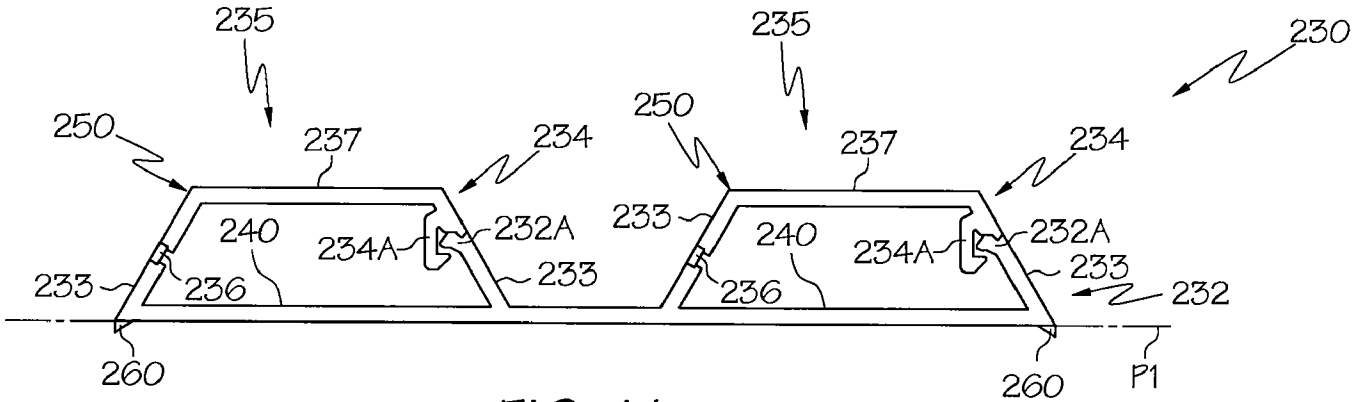
FIGS. 4A and 4B are cross-sectional illustrations of a construction component according to the present invention configured as yet another type of rustication.
Figure 4B:
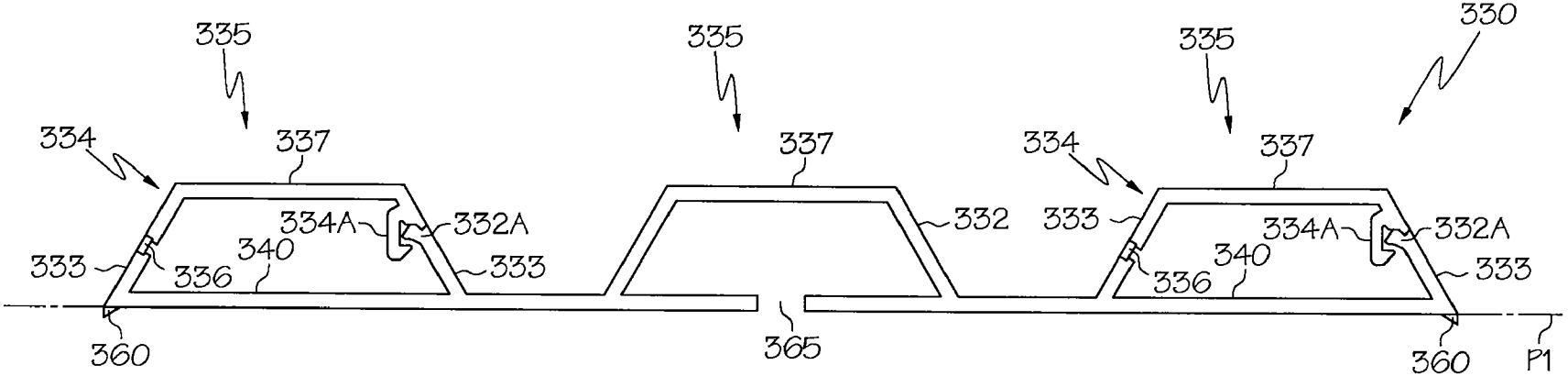

In the embodiments of FIGS. 4A and 4B, the panel forming face 235, 335 comprise a plurality of profiled portions 250, 350, each comprising a pair of beveled edges 233, 333. Selected profiled portions 250, 350 are provided with hinged portions 234, 334 providing access to a component securing surface 240, 340.

Figure 3:
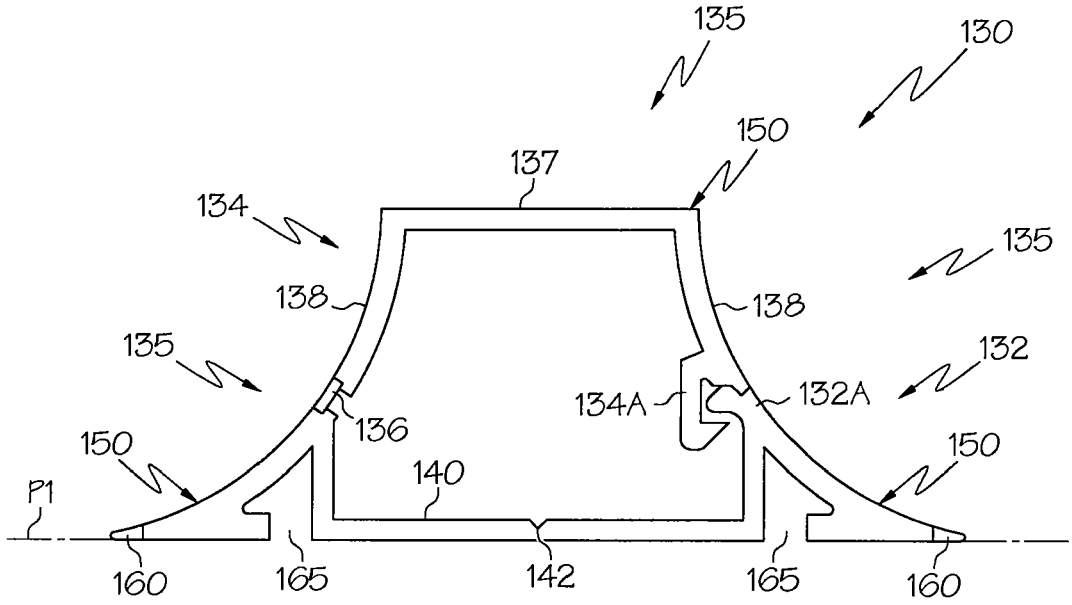
FIG. 3 is a cross-sectional illustration of a construction component according to the present invention configured as another type of rustication.

Turning to the embodiment of the present invention illustrated in FIG. 3, the panel forming face 135 comprises a single profiled portion 150 including a pair of inwardly curved edge portions 38 linked by a substantially planar face portion 137 extending there between. The hinged portion 134 of the construction component 130 illustrated in FIG. 3 provides access to a component securing surface 140 and defines at least a portion of the substantially planar face portion 137 linking the inwardly curved edge portions 138.

Figure 5:
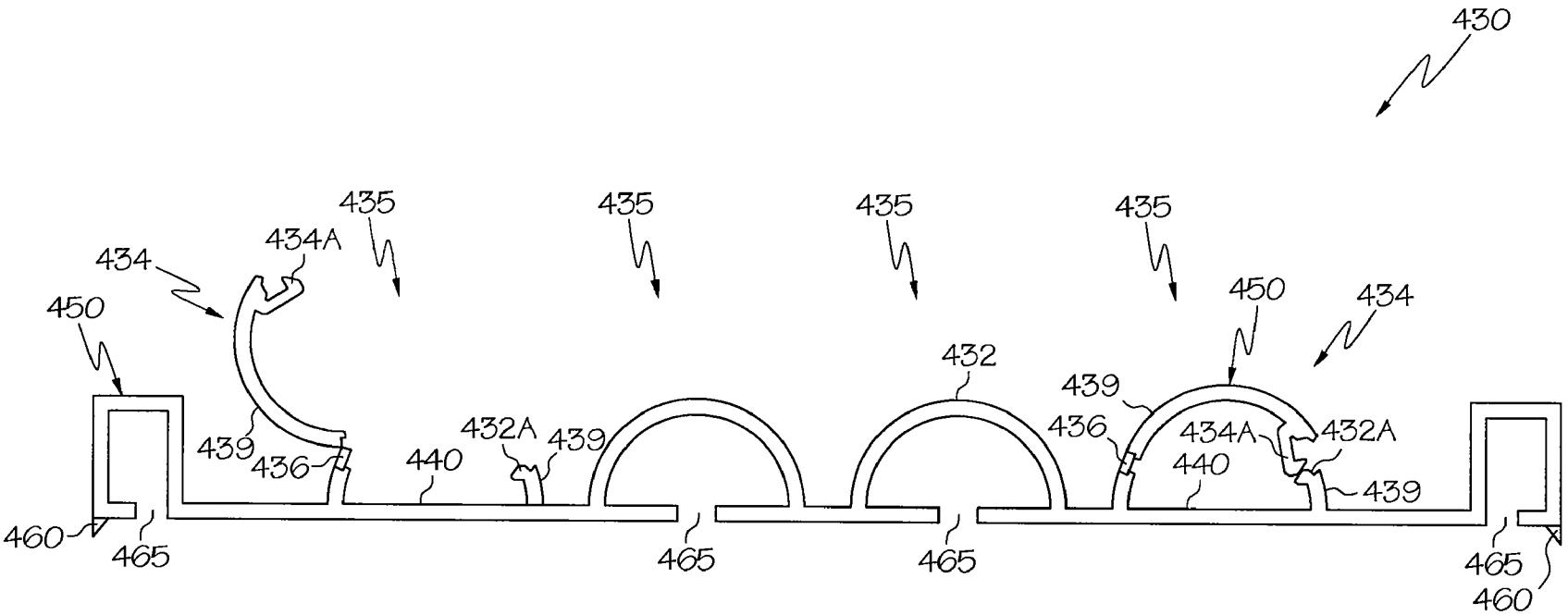
FIG. 5 is a cross sectional illustration of a construction component according to the present invention configured as an additional type of rustication.

Additional profiled portions 450 according to the present invention are illustrated in FIG. 5. Specifically, the profiled portions 450 illustrated in FIG. 5 comprise a pair of outwardly curved edges 439. The hinged portion 434 of the construction component 430 provides access to the component securing surface 440 and defines at least a portion of the outwardly curved edges 439.

Figure 6:
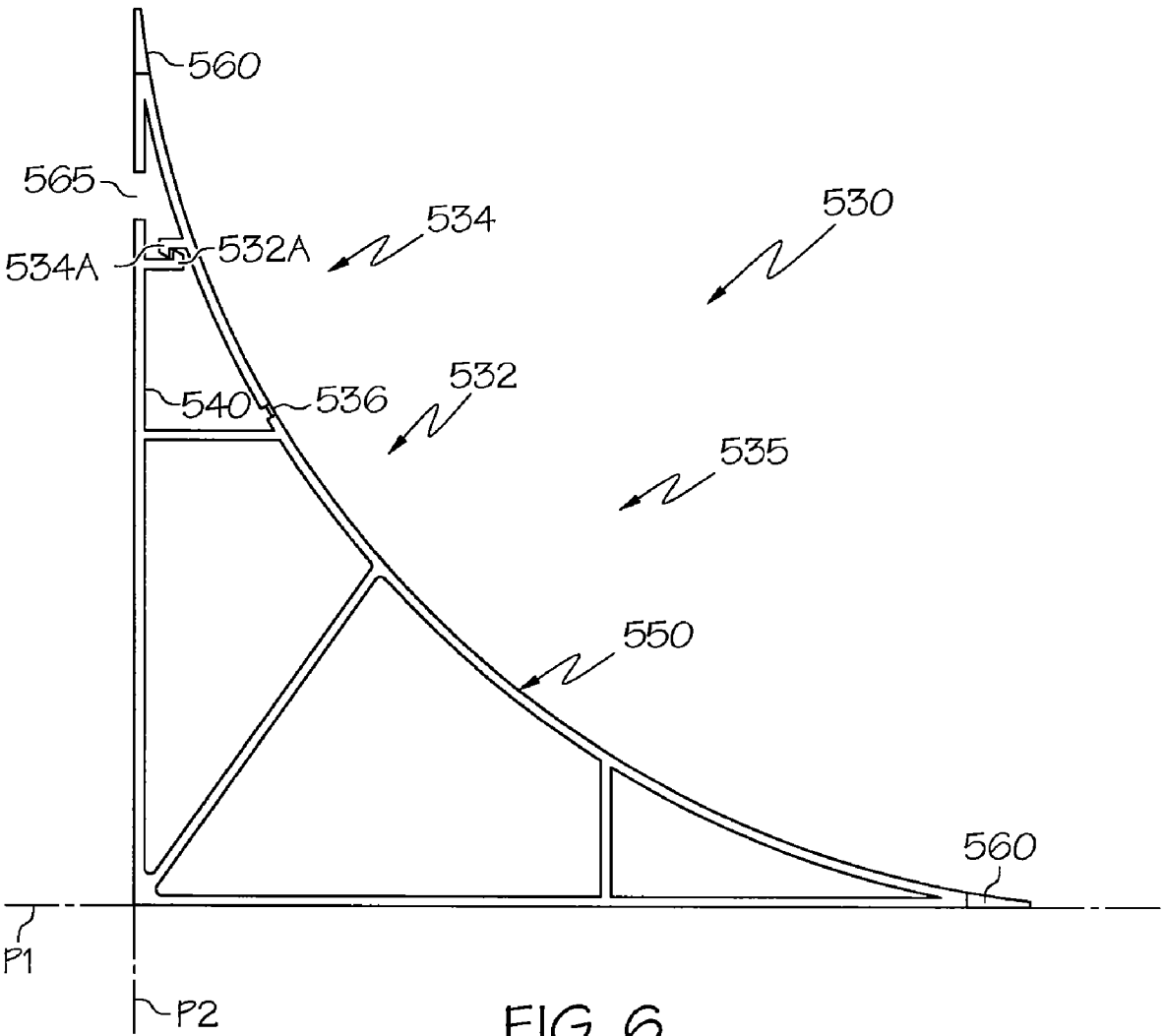
FIG. 6 is a cross sectional illustration of a construction component according to the present invention configured as a corner chamfer.

In the embodiment illustrated in FIG. 6, the panel forming face 535 defines a corner chamfer configured such that uncured material may be cured against and subsequently released from the panel forming face 535 to define a cured panel comprising a chamfered corner formed therein. The corner chamfer illustrated in FIG. 6 defines an inwardly curved panel forming face 535. However, it is contemplated that corner chamfers according to the present invention may be configured to incorporate a variety of profiles including, but not limited to, a beveled portion, an inwardly curved portion, an outwardly curved portion, or combinations thereof. In any case, the hinged portion 534 illustrated in FIG. 6 provides access to a component securing surface 540 that can be aligned along a bulkhead 20, a panel forming slab 10, or another suitable panel forming surface.

Referring collectively to FIGS. 2-6, it is noted that the present invention also relates to the provision of pliant sealing edges 60, 160, 260, 360, 460, 560 extending along the longitudinal dimension of the construction component 30, 130, 230, 330, 430, 530, at one or more of its lateral edges. Pliant sealing edges 60, 160, 260, 360, 460, 560 according to the present invention can be configured to extend beyond or along one or more relatively rigid contact planes P1, P2 defined by the extruded cross-sectional profile of the component. For the purposes of defining and describing the present invention, it is noted that the contact planes P1, P2 are referred to herein as being relatively rigid because they are defined by the relatively rigid material of the component 30,130, 230, 330, 430, 530, as opposed to the relatively pliant material of the sealing edge 60, 160, 260, 360, 460, 560 and hinge 36, 136, 236, 336, 436, 536.

Where a pliant sealing edge 60, 160, 260, 360, 460, 560 is configured to extend beyond a particular contact plane P1, P2, it is contemplated that it may be preferable to ensure that the sealing edge extends at least about 1/32" (0.75 mm) beyond the plane. Similarly, where a pliant sealing edges 60, 160, 260, 360, 460, 560 is configured to extend along a particular contact plane P1, P2, it is contemplated that it may be preferable to ensure that the sealing edge extends along the plane for at least about 1/8" (3 mm).

The pliant sealing edges 60, 160, 260, 360, 460, 560 and the panel forming face 35 define integral portions of the extruded cross-sectional profile and are formed of materials characterized by substantially different degrees of structural rigidity. In this manner, material forming the pliant sealing edge 60, 160, 260, 360, 460, 560 is substantially less rigid than material forming the panel forming face 35. As a result, construction components 30, 130, 230, 330, 430, 530 according to the present invention maintain a high degree of structural integrity because the panel forming face 35, 135, 235, 335, 435, 535 is substantially rigid. In addition, construction components 30,130, 230, 330, 430, 530 according to the present invention are characterized by enhanced functionality because the pliant sealing edges 60, 160, 260, 360, 460, 560 incorporated therein provide for enhanced sealing properties, particularly where they interface with slabs 10 or bulkheads 20 of inconsistent quality.

For example, a construction component 30, 130, 230, 330, 430, 530 that is substantially linear along its longitudinal dimension may be limited to some extent in its ability to interface with a panel forming slab 10 including slight undulations or irregularities in its surface. By providing a pliant sealing edge 60, 160, 260, 360, 460, 560 at one or more lateral edges of the component 30, 130, 230, 330, 430, 530, the ability of the component to vary from a substantially linear orientation along the longitudinal axis of the component 30, 130, 230, 330, 430, 530 at the lateral edge is enhanced. In addition, pliant sealing edges 60, 160, 260, 360, 460, 560 also help account for instances where variations in the longitudinal linearity of the component 30, 130,230, 330,430, 530 would allow un-cured material to seep beyond the bounds defined by the construction component 3, 130, 230, 330, 430, 530.

FIGS. 3, 4B, and 5 illustrate an additional feature of the present invention. Specifically, each of the components 130, 330, 430 illustrated includes an extruded cross-sectional profile that defines a relatively rigid contact plane P1 beyond which the pliant sealing edge 160, 360, 460 is configured to extend. A structural discontinuity 165, 365, 465 is defined in the contact plane P1 and is configured to allow distortion of the contact plane P1 under pressure applied to the pliant sealing edge 160, 360, 460. As a result, the degree to which the lateral edge can vary from a substantially linear orientation along the longitudinal axis of the component 130, 330, 430 is enhanced and the construction component 130, 330, 430 can interface with irregular surfaces with more reliability.

Construction components according to the present invention are typically formed from a plastic material, e.g., polyvinyl chloride (PVC), low or high-density polyethylene or polypropylene, acrylics, polycarbonates, thermoplastic elastomers, etc. Because the construction components according to the present invention include relatively rigid and relatively pliant materials, they may be fabricated by generating a co-extrusion defining a cross section including relatively rigid portions and relatively pliant portions. The relatively pliant portions may be extruded using softer plastics like soft, flexible thermoplastic elastomers, or other relatively soft materials.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise a construction component according to the present invention or a panel forming system incorporating a construction component according to the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A panel forming system comprising a horizontally oriented panel forming slab, a plurality of vertically oriented panel forming bulkheads, and a construction component, wherein:

said panel forming slab and said panel forming bulkheads cooperate to form a panel forming section;

said panel forming section is configured to receive and contain an un-cured material and to define a shape of said un-cured material as said un-cured material cures in said panel forming section;

said construction component comprises a set portion, a hinged portion, and a hinge that cooperate to define a co-extruded cross-sectional profile;

said set portion defines a base surface and comprises a plurality of pliant sealing edges that extend from lateral edges of said set portion;

said base surface of said set portion is forcibly secured to said panel forming slab with one or more securing members such that said pliant sealing edges are compressed against said panel forming slab to prevent seepage of said un-cured material between said set portion and said panel forming slab;

said set portion, said hinged portion, and said hinge define a panel forming face, said panel forming face being both configured such that said un-cured material contained in said panel forming section cures against and subsequently releases from said panel forming face in a substantially unobstructed manner and configured to further define said shape of said un-cured material as said un-cured material cures in said panel forming section;

said set portion and said hinged portion are configured to define an engagement;

said set portion and said hinged portion are configured to interface along said panel forming face at said engagement;

said engagement is defined by at least three distinct planes of support; and said hinge couples said set portion and said hinged portion such that said hinged portion is movable about said hinge between an engaged state and a disengaged state with said set portion.

2. A panel forming system as claimed in claim 1, wherein said construction component is configured such that movement of said hinged portion from said engaged state to said disengaged state reveals a component securing surface of said construction component.

3. A panel forming system as claimed in claim 1, wherein said panel forming face comprises at least one profiled portion defining a said panel forming face, said profiled portion selected from the group consisting of a beveled portion, an inwardly curved portion, an outwardly curved portion, and combinations thereof.

4. A panel forming system as claimed in claim 3, wherein said panel forming face comprises said profiled portion and said hinged portion of said construction component defines at least a portion of said profiled portion.

5. A panel forming system as claimed in claim 3, wherein said panel forming face comprises said profiled portion and said set portion of said construction component defines at least a portion of said profiled portion.

6. A panel forming system as claimed in claim 3, wherein said panel forming face comprises said profiled portion and said hinged and set portions of said construction component define at least a portion of said profiled portion.

7. A panel forming system as claimed in claim 1,wherein said set portion said hinged portion, and said hinge define said panel forming face substantially entirely.

8. A panel forming system as claimed in claim 1,wherein:

said panel forming face comprises at least one profiled portion; and said profiled portion comprises a pair of beveled edges.

9. A panel forming system as claimed in claim 8, wherein said beveled edges are linked by a substantially planar face portion extending there between.

10. A panel forming system as claimed in claim 9, wherein said hinged portion of said construction component defines at least a portion of said substantially planar face portion linking said beveled edges.

11. A panel forming system as claimed in claim 9, wherein said set portion and said hinged portion interface along said panel forming face at said hinge.

12. A panel forming system as claimed in claim 1,wherein:

said pliant sealing edges and said panel forming face define integral portions of said co-extruded cross-sectional profile and are formed of materials characterized by substantially different degrees of structural rigidity such that material forming said pliant sealing edges is substantially less rigid than material forming said panel forming face.

13. A panel forming system as claimed in claim 1, wherein said base surface is a single, relatively rigid surface.

14. A panel forming system as claimed in claim 13, wherein:

said lateral edges and said pliant sealing edges extend along a longitudinal dimension of said construction component; and each of said pliant sealing edges are configured to extend beyond or along said base surface.

15. A panel forming system as claimed in claim 14, wherein each of said pliant sealing edges are configured to extend beyond said base surface by at least about 1/32" (0.75 ram).

16. A panel forming system as claimed in claim 1, wherein said construction component comprises a profiled supplemental panel form.

17. A panel forming system as claimed in claim 1, wherein said construction component comprises a rustication

* * * * *

UNITED STATES PATENT AND TRADEMARK OFFICE

CERTIFICATE OF CORRECTION

PATENT NO. : 7,530,544 B2
APPLICATION NO. : 11/056943
DATED : May 12, 2009
INVENTOR(S) : Kyozaburo Takagi It is certified that error appears in the above-identified patent and that said Letters Patent is hereby corrected as shown below:

Col. 8, Line 25 “ram” should read --mm--.

Signed and Sealed this

Fourth Day of August, 2009

JOHN DOLL
*Acting Director of the United States Patent and Trademark Office*